US005735548A

United States Patent [19]

Anderson

[11] Patent Number: 5,735,548

[45] Date of Patent: Apr. 7, 1998

[54] FOOD DONATOR IDENTIFICATION CONTAINER

[76] Inventor: Gwendolyn T. S. Anderson, 2966 Frazer Rd., Newark, Del. 19702

[21] Appl. No.: 333,312

[22] Filed: Nov. 1, 1994

[51] Int. Cl.[6] ..... B12D 15/00

[52] U.S. Cl. ..... 283/75; 283/74; 10/312

[58] Field of Search ..... 283/79, 74, 80, 283/75, 81, 117; 206/139, 192, 427, 431, 434, 501, 514, 515, 534, 554, 459.5; 383/37, 127, 907

[56] References Cited

U.S. PATENT DOCUMENTS

| | | | |
|---|---|---|---|
| 4,526,404 | 7/1985 | Vazquez | 283/7 |
| 4,580,360 | 4/1986 | Gribb | 40/2 R |
| 4,781,378 | 11/1988 | Clinnon et al. | 283/79 X |
| 4,787,754 | 11/1988 | Herrington | 383/63 |
| 4,787,755 | 11/1988 | Branson | 383/65 |
| 4,832,188 | 5/1989 | Christie | 206/139 X |
| 5,004,104 | 4/1991 | Sanlas | 206/434 X |
| 5,174,659 | 12/1992 | Laske | 383/207 |
| 5,195,639 | 3/1993 | Zinbarg | 206/457 |

FOREIGN PATENT DOCUMENTS

| | | | |
|---|---|---|---|
| 4887845 | 5/1989 | Japan | 283/81 |

*Primary Examiner*—Willmon Fridie, Jr.
*Attorney, Agent, or Firm*—E. Alan Uebler, P.A.

[57] ABSTRACT

A container system for food is provided, especially suited for confections received by a donee from donors at Halloween, which identifies the various donors by name and/or address. The container system comprises at least one first receptacle having an opening for receiving donated food items from a donor. The first receptacle has indicia thereon for identifying the donor and closure means for closing the opening. The indicia may be preprinted and may include the word "ADDRESS", the word "NAME" or some other suitable identification. A second, larger receptacle is provided having an opening for receiving and carrying a plurality of the first receptacles. The container system may have identifiable indicia entered by a separate recording device such as a pencil or pen to enable the donee to record and identify the donor of the food items contained in each of the first receptacles. The first receptacles may be boxes with lids, bags, either paper or plastic, or other suitable containers. The second, larger receptacle may be a paper bag or a plastic bag, and both first and second receptacles may have decorative indicia thereon, thematic of Halloween, for example.

18 Claims, 2 Drawing Sheets

FOOD DONATOR IDENTIFICATION CONTAINER

BACKGROUND OF THE INVENTION

1. Field of Invention

This invention relates to containers, specifically containers for holding food received by a donee from a donor, such as a halloween trick-or-treat bag.

2. Description of Prior Art

Holidays and special occasions have been tarnished by humans who place foreign objects in food. This is most evident, but not limited, to the celebration of Halloween. Some humans have chosen to alter their traditional way of celebrating the holiday, while others continue to celebrate Halloween by gathering candy from neighbors.

People who still celebrate Halloween by gathering candy from neighbors place all collected candy into large Halloween bags. When foreign objects began to be found in candy, the public responded by implementing an x-ray screening process in hospitals. However, this approach was phased out because of several reasons:

(a) High costs to hospitals for purchasing x-ray film and for employing additional staff to operate the machines;

(b) Diminished demand from the public because of the inconvenience to travel to the hospitals;

(c) Potential liability hospitals faced if a child was hurt or killed after eating tainted candy that an x-ray showed was safe to eat. This scenario was likely to occur because an x-ray machine only identifies metal objects such as razors and pins, and does not identify non metal objects such as plastic or drugs;

(d) The x-ray machine examinations at hospitals did not identify the person who inserted foreign object into the candy.

The purpose of large Halloween bags is to hold candy that is received from neighbors—for example, as disclosed in U.S. Pat. No. D258205. That invention suffers from a number of disadvantages:

(a) The bag does not provide a means for grouping candy donated by each person;

(b) The bag does not provide a means for identifying the person who donates the candy;

(c) The invention does not deter individuals from inserting foreign objects in candy.

Recently, individual trick or treat bags (see attachment A) were marketed. However, the purpose of that invention fails to identify the person who donates candy that has been tampered with. That invention suffers from a number of disadvantages:

(a) The bag does not have a closure for securing candy;

(b) The bag does not provide a means for identifying the person who donates the candy;

(c) The design does not provide a space for writing identifying information about the person who donates the candy;

(d) The invention does not deter individuals from inserting foreign objects in candy.

The current "ziploc" style bags—for example, as disclosed U.S. Pat. Nos. 5,174,659; 4,787,755 does provide a means to secure donated candy. However, that invention suffers from the following disadvantages:

(a) The bag does not provide a means for identifying the person who donates the candy;

(b) The invention does not deter individuals from inserting foreign objects in candy.

The "ziploc" style bags with write on labels are used to identify the contents and the date the contents were inserted in the bag (see attachment B). However, this invention suffers from the following disadvantages:

(a) The bag does not provide a means identify the person who hands out the candy;

(b) The invention does not deter individuals from inserting foreign objects in candy.

Several objects and advantages of the present invention are:

(a) to provide a bag that has a closure for securing food;

(b) to provide a means for grouping food donated from each person;

(c) to provide a method for identifying persons who hand out food that has been tampered with;

(d) to provide a space to write identifying information about the person who handed out the food;

(e) to deter individuals from donating food with foreign objects inserted in it.

Further objects and advantages are to provide an inexpensive means whereby both the receiver and donator of the food can identify the person who hands out food, which is simple to use and inexpensive to manufacture, which can be used with various size containers and made of various types of material, which can be used with containers of preprinted identification writing spaces, and which can be used with self adhesive labels and placed on containers. Still further objects and advantages of my invention will become apparent from a consideration of the drawings and ensuing description (prototype is referenced in attachment C).

SUMMARY OF THE INVENTION

A container system for food is provided, especially suited for confections received by a donee from donors at Halloween, which identifies the various donors by name and/or address. The container system comprises at least one first receptacle having an opening for receiving donated food items from a donor. This first receptacle has indicia thereon for identifying the donor and closure means for closing the opening. The indicia may be preprinted and may include the word "ADDRESS", the word "NAME" or some other suitable identification. A second, larger receptacle is provided having an opening for receiving and carrying a plurality of the first receptacles. The identifiable indicia may be entered by a separate recording device such as a pencil or pen to enable the donee to record and identify the donor of the food items contained in each of the first receptacles. The first receptacles may be boxes with lids, bags, either paper or plastic, or other suitable containers. The second, larger receptacle may be a paper bag or a plastic bag, for example, and both first and second receptacles may have decorative indicia thereon, thematic of Halloween.

BRIEF DESCRIPTION OF THE DRAWINGS

In the drawings, closely related figures have the same number but different alphabetic suffixes.

REFERENCE NUMERALS IN DRAWINGS/ GLOSSARY

Figure 1A:
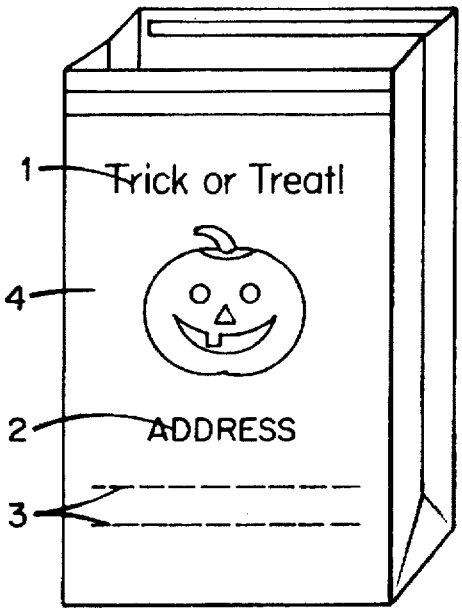
FIGS. 1A and 1B show various types of empty decorative identification containers with the preprinted word ADDRESS on one side of it, and preprinted horizontal lines below the preprinted word ADDRESS for a human to write identifying information about the person donating food.

1 Decorative thematically related object or character

2 Preprinted word ADDRESS

3 Preprinted horizontal lines

4 Empty decorative identification container

5 Writing surface

6 Writing utensil

7 Writing utensil holder

8 Binder clip

9 Filled and closed decorative identification container

10 Address and name of food donator

11 Donated food

12 Large decorative non identifying container

DETAILED DESCRIPTION OF THE INVENTION AND PREFERRED EMBODIMENTS WITH REFERENCE TO THE DRAWINGS

Figure 1B:
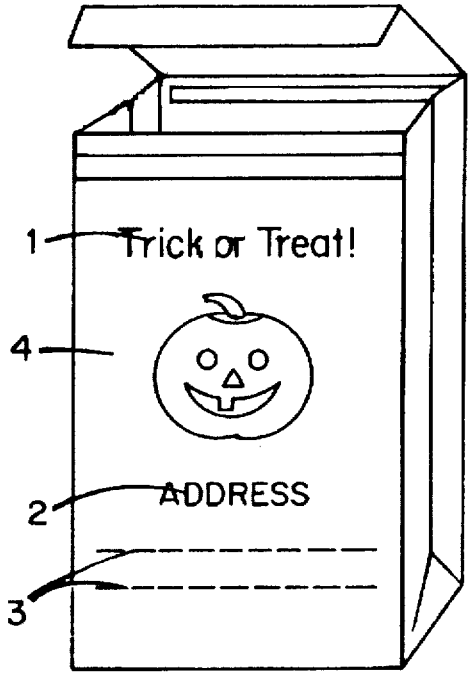
Figure 2:
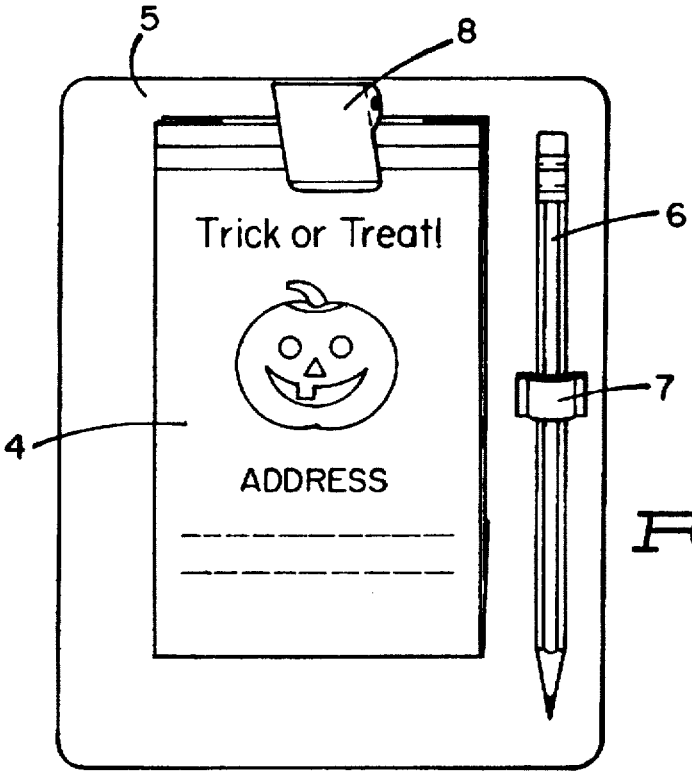
FIG. 2 shows an empty identification bag and a writing utensil that is attached to a flat rigid writing surface of sufficient size to hold the empty container for the purpose for a human to write identifying words that identify the respective food donator.
Figure 3:
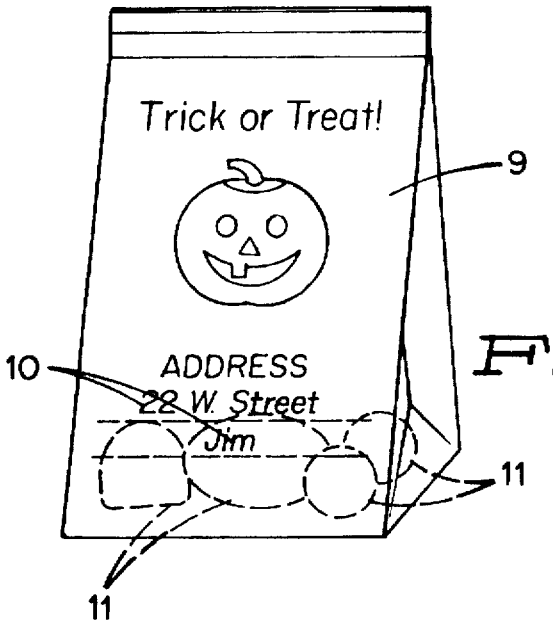
FIG. 3 shows a filled, closed identification container with the address and first name of the person who donated the food.
Figure 4:
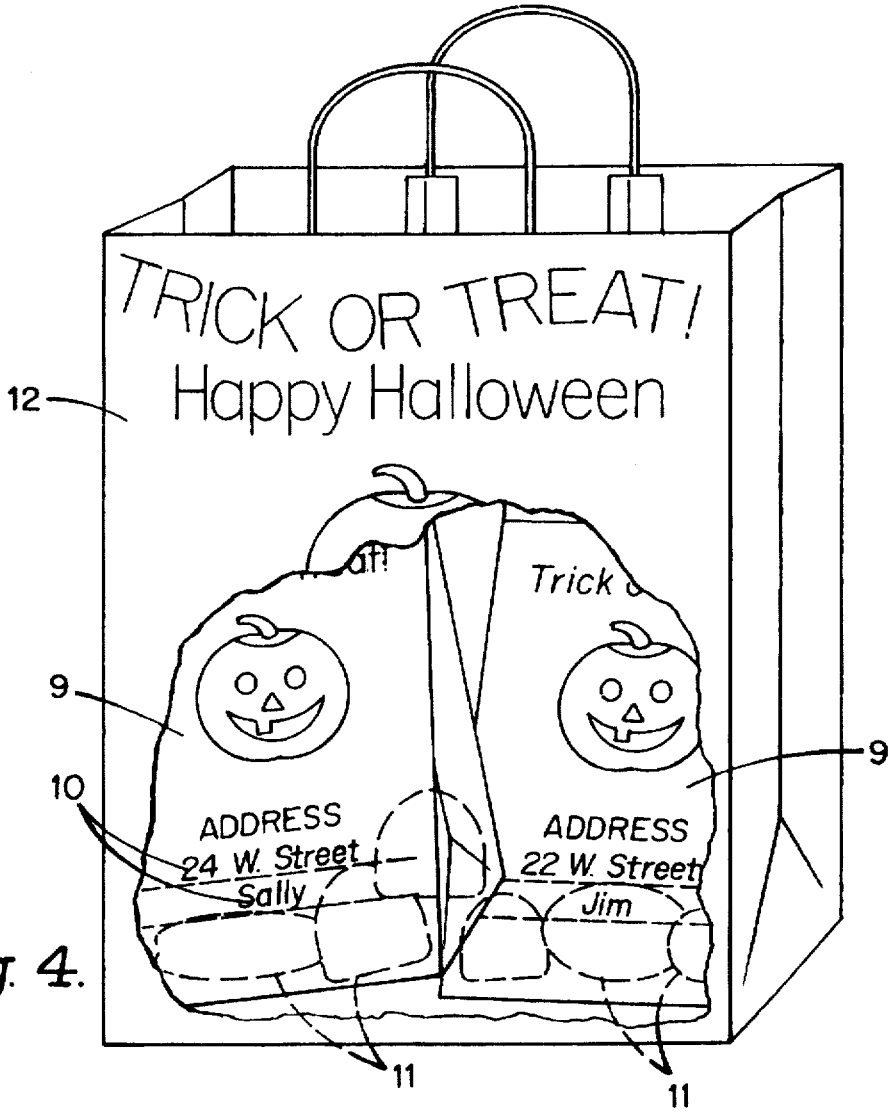
FIG. 4 shows a large decorative non identifying container that contains two filled and closed decorative identification containers.

The embodiment of the container of the present invention is illustrated in FIGS. 1 to 4. The empty decorative identification container 4 in FIGS. 1A and 1B has a decorative thematically related object or character 1 on one side of the container. The container also has the preprinted word address 2 in capital letters and preprinted horizontal lines 3 below the word address. The empty decorative identification container 4 in FIG. 2 is fastened to a binder clip 8 which is attached to a writing surface 5. The writing utensil holder 7 fastens the writing utensil 6 to the writing surface 5 in FIG. 2. The filled and closed decorative identification container 9 in FIG. 3, is filled with donated food 11. The address and name of the food donator 10 in FIG. 3 is printed on the preprinted horizontal lines 3 of the filled and closed decorative identification container 9. The large decorative non identifying container 12 in FIG. 4 contains two filled and closed decorative identification containers 9 which has the address and name of the food donator 10.

What sets this invention off from other containers is in its ability to change the operation and usage of a combination of present inventions. While I believe the most efficient manner in which this invention can be used is described below, I don't wish to be bound by this.

The receiver of donated food shall write appropriate identifier of the of the food donator on the preprinted horizontal lines 3 of the empty decorative identification container 4 in FIGS. 1A and 1B. Then, the receiver of the donated food shall collect and insert the donated food from the food donator into a empty decorative identification container 4 that identifies the food donator. The receiver of the donated food 11 shall ensure that the filled decorative identification container is sealed shut 9, and shall place it in the large decorative non identifying container 12 in FIG. 4.

If the food donator already inserted the donated food 11 of FIG. 3 into an empty decorative identification container 4, the receiver of the donated food shall review the address and name that the food donator wrote on the respective filled and closed decorative identification container 9 for accuracy. Also, the receiver of the donated food still may write the address and name of the food donator 10 on an empty decorative identification container 4 and place the food donator's filled and closed decorative identification container in his/her own empty decorative identification container 4 for confirmation of the food donator's address and name.

Although this product may deter some individuals from inserting foreign objects in food, it is important that the receiver of the donated food does not eat any donated food until the donated food is thoroughly inspected.

Accordingly, the reader will see that identification containers of this invention can be used to group and examine donated food and identify individuals who handout food that has been tampered with. In addition, when the identification container has been used to identify the individual who donated food that has been tampered with, and if foreign objects in he donated food are found during the inspection, the receiver of the donated food shall inform the return the tampered with donated food to the respective identification container that properly identifies the person who donated the tampered with food. Also the receive of the donated food shall contact the police who will be able inspect the donated food and the identification container from which it came for a possible suspect. Also, the police can retain the tampered with donated food as evidence.

Although the description above contains many specificities, these should not be construed as limiting the scope of the invention but is merely providing illustrations of some of the presently preferred embodiments of this invention. For example, the shape of container can have other shapes, such as circular, oval trapezoidal, triangular, etc.; the material of the container can be paper, paperboard, hard plastic, flexible plastic, translucent plastic, transparent plastic etc.; a self adhesive label can be placed on the containers as the writing space rather than preprinting the address and horizontal lines on the container, etc.; various sizes of containers can be used etc.; various types of decorative thematically related objects or characters can be printed on the identification containers, or no decorative thematically related object or character can be used etc.; a preprinted writing space can be provided or no preprinted writing can be used etc.; several processes can be used to keep track of the food donators. For example, the receiver of the donated food can write the identifier on a pre-numbered sheet of paper and place the corresponding number on the identification container rather than writing food donator's address or name. The steps used to identify each food donator can be interchangeable. For example, the identifier can be written on the container after the donated food is placed in the food donating identification container. The food donator identification containers can be used by the receiver of the donated food, the food donator, the manufacturer of the food etc.

Thus the scope of the invention should be determined by the appended claims and their legal equivalents, rather than by the examples given.

I claim:

1. Container means for food, especially confections received by a donee from a donor at Halloween, said container means comprising:

(a) a first receptacle having an opening for receiving donated food items from a donor, and having means thereon for identifying said donor, said first receptacle having closure means for closing said opening, and (b) a second receptacle having an opening for receiving and holding a plurality of said first receptacles.

2. The container means of claim 1 wherein said identifying means comprises indicia preprinted on said first receptacle for identifying said donor.

3. The container means of claim 2 wherein said indicia includes the word "ADDRESS".

4. The container means of claim 2 wherein said indicia includes the word "NAME".

5. The container means of claim 1 wherein said identifying means comprise identifiable indicia preprinted on each said first receptacle and separate recording means to enable the donee to record and identify the donor of the food items contained in each said first receptacle.

6. The container means of claim 1 wherein said first receptacle comprises a box.

7. The container means of claim 6 wherein said closure means comprises a lid.

8. The container means of claim 1 wherein said first receptacle comprises a bag.

9. The container means of claim 8 wherein said closure means comprises at least one fold closing said bag near said opening.

10. The container means of claim 8 wherein said first receptacle is a paper bag.

11. The container means of claim 8 wherein said first receptacle is a plastic bag.

12. The container means of claim 1 wherein said first receptacle has decorative indicia thereon.

13. The container means of claim 1 wherein said second receptacle has decorative indicia thereon.

14. The container means of claim 12 wherein said decorative indicia are thematic of Halloween.

15. The container means of claim 13 wherein said decorative indicia are thematic of Halloween.

16. The container means of claim 1 wherein said second receptacle is a paper bag.

17. The container means of claim 1 wherein said second receptacle is a plastic bag.

18. The container means of claim 1 wherein said second receptacle has handle means for ease of transport thereof.

* * * * *